US010051927B2

(12) United States Patent
Smith

(10) Patent No.: US 10,051,927 B2
(45) Date of Patent: Aug. 21, 2018

(54) ZIP SLIDER

(71) Applicant: J & P COATS LIMITED, Uxbridge, Middlesex (GB)

(72) Inventor: Steven Smith, Shenzhen (CN)

(73) Assignee: J & P COATS LIMITED, Uxbridge (GB)

( * ) Notice: Subject to any disclaimer, the term of this patent is extended or adjusted under 35 U.S.C. 154(b) by 0 days.

(21) Appl. No.: 15/301,228

(22) PCT Filed: Mar. 31, 2015

(86) PCT No.: PCT/GB2015/000108
§ 371 (c)(1),
(2) Date: Sep. 30, 2016

(87) PCT Pub. No.: WO2015/150724
PCT Pub. Date: Oct. 8, 2015

(65) Prior Publication Data

US 2017/0013920 A1 Jan. 19, 2017

(30) Foreign Application Priority Data

Mar. 31, 2014 (GB) ..... 1405748.3

(51) Int. Cl.
*A44B 19/30* (2006.01)
*A44B 19/26* (2006.01)

(52) U.S. Cl.
CPC ..... *A44B 19/308* (2013.01); *A44B 19/262* (2013.01); *A44B 19/306* (2013.01)

(58) Field of Classification Search
CPC ... A44B 19/308; A44B 19/262; A44B 19/306; Y10T 24/2571; Y10T 24/2568; Y10T 24/2586
See application file for complete search history.

(56) References Cited

U.S. PATENT DOCUMENTS 4,102,022 A * 7/1978 Aoki ..... A44B 19/308 24/421
4,391,022 A * 7/1983 Oda ..... A44B 19/306 24/421
4,422,220 A * 12/1983 Oda ..... A44B 19/306 24/421
4,768,263 A * 9/1988 Fukuroi ..... A44B 19/306 24/418

(Continued)

*Primary Examiner* — Robert Sandy
*Assistant Examiner* — Rowland Do
(74) *Attorney, Agent, or Firm* — Oliff PLC

(57) ABSTRACT

A zip slider has: a slider body having upper and lower elements providing two entry channels through which zip teeth pass and slider un/mating; a pull tab having a cam; a biasing spring having a locking prong and a follower surface bearing against the cam. The cam on the follower surface biases the tab into a closed position in which it lies against the upper element. When the tab is in a lifted position, the cam action on the follower surface raises the prong above the mated teeth, enabling relative motion of the teeth and body; when the tab is in the closed position, the prong bears against the teeth to prevent unwanted relative slider and teeth motion. The slider has a counter bias, acting between the upper element and the tab to apply a biasing force on the tab acting against the action of the cam and follower surface.

7 Claims, 4 Drawing Sheets

(56) References Cited

U.S. PATENT DOCUMENTS

| | | | | | |
|---|---|---|---|---|---|
| 5,031,286 | A * | 7/1991 | Kedzierski | A44B 19/26 | 24/421 |
| 5,152,036 | A * | 10/1992 | Oda | A44B 19/308 | 24/421 |
| 5,528,802 | A * | 6/1996 | Akashi | A44B 19/303 | 24/418 |
| 5,544,394 | A * | 8/1996 | Yaguramaki | A44B 19/308 | 24/424 |
| 5,809,622 | A * | 9/1998 | Yaguramaki | A44B 19/308 | 24/419 |
| 5,896,628 | A * | 4/1999 | Oda | A44B 19/306 | 24/421 |
| 6,497,016 | B1 * | 12/2002 | Lin | A44B 19/308 | 24/418 |
| 6,510,594 | B2 * | 1/2003 | Lin | A44B 19/308 | 24/419 |
| 6,588,072 | B1 * | 7/2003 | Lin | A44B 19/265 | 24/416 |
| 6,591,464 | B2 * | 7/2003 | Lin | A44B 19/308 | 24/419 |
| 6,637,078 | B2 * | 10/2003 | Nagata | A44B 19/306 | 24/419 |
| 7,257,869 | B2 * | 8/2007 | Lin | A44B 19/262 | 24/421 |
| 8,567,019 | B2 * | 10/2013 | Yamamoto | A44B 19/306 | 24/419 |
| 2002/0000025 | A1 * | 1/2002 | Yamagishi | A44B 19/306 | 24/421 |
| 2002/0152591 | A1 * | 10/2002 | Nagata | A41F 1/002 | 24/303 |
| 2005/0125967 | A1 * | 6/2005 | Yamagishi | A44B 19/306 | 24/420 |

* cited by examiner

ZIP SLIDER

BACKGROUND TO THE INVENTION

1. Field of the Invention

The present invention relates to a slider for a zip fastener and, more particularly, to a zip slider incorporating a mechanism to retain a pull tab in a closed position which then prevents vibration of the pull tab relative to the slider body.

2. Description of Related Art

Anti-vibration zip sliders are known per se. Typically, such a slider will have a body comprising upper and lower interconnected elements which cooperate to provide the entry channels via which, during relative motion of the zip tape and slider, the zip teeth are fed into or out of a single, central channel where the zip teeth knit or unknit during fastening or unfastening of the zip. Typically, the slider will additionally comprise a spring-loaded locking prong mounted on the slider body, which projects into the central channel. The locking prong is typically formed from a leaf spring material and, in use, bears against the knitted zip teeth thereby to prevent unwanted movement of the slider. A pull tab, pivotally mounted on the body is the means by which a user moves the slider. The pull tab has a cam formed at pivoting axis which, typically, cooperates with a follower surface provided on the same leaf spring element from which the locking prong is formed. When the pull tab 60 lies flat against the upper element of the slider body in a 'closed' or 'resting' position, the follower surface of the leaf spring acts on the cam to provide a resting bias and to bias the pull tab 60 into the resting position; and the locking prong—formed at the other end of the same leaf spring element—is allowed project fully into the channel and to bear against the zip teeth to lock the position of the zip slider. Conversely, when the pull tab is pivoted out of the resting position, to a position in which it is pivoted away from the body to enable a user to hold it, the cam acts on the follower surface of the leaf spring element to cause the locking prong to lift from the zip teeth, thereby unlocking the zip slider and enabling relative motion of the slider and teeth. In this way, a zip slider can be provided which has locking capability and, at the same time, when locked, whose pull tab is retained in a closed position without the possibility of vibration against the slider body.

Most usually, when the zip slider is in the locked position the locking prong will bear on the zip teeth in a ridge created between two adjacent teeth. In such a position, the locking prong will adopt its position of greatest displacement into the channel. That, in turn, means that the force applied on the cam of the pull tab by the follower surface to bias the pull tab into the resting position will then be at its greatest. Occasionally, however, the relative displacement of the zip slider and zip teeth is such that the locking prong will bear upon the top of a single zip tooth. The consequence of this is that the follower surface then bears less strongly against the cam and so applies a lesser biasing force with the result that the pull tab may then either move a little from the resting position or move a little more easily from that position. Either outcome can give rise to vibration and possibly noise. This is undesirable.

SUMMARY OF THE INVENTION

The present invention provides a zip slider which ameliorates the above mentioned problems.

According to a first aspect of the present invention there is provided a zip slider comprising a body movable along opposing pairs of zip teeth to cause inter and extradigitation of the zip teeth; a pull tab pivotally mounted to the body and having a resting position in which it lies against the body and a pulling position in which it is pivoted from the resting position; a locking prong which is engaged with interdigitated teeth to prevent relative motion of the slider and teeth when the pull tab is in the resting position, and disengaged to permit the relative motion when in the pulling position; a damping bias acting to apply a damping bias to the pull tab relative to the body when in the resting position.

BRIEF DESCRIPTION OF DRAWINGS

Embodiments of the invention will now be described, by way of example, in which.

DESCRIPTION OF PREFERRED EMBODIMENTS

Figure 2:
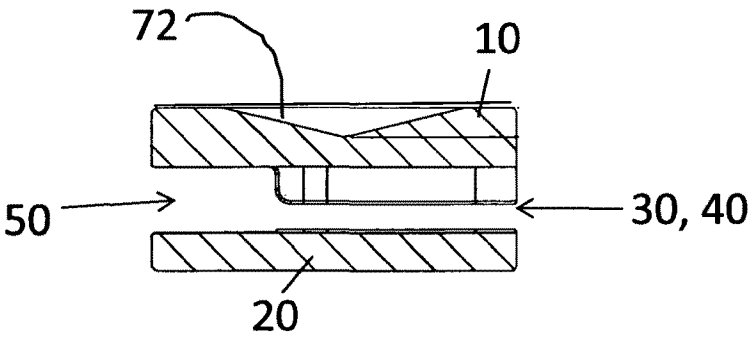
FIG. 2 is a section on A-A in FIG. 1.
Figure 1:
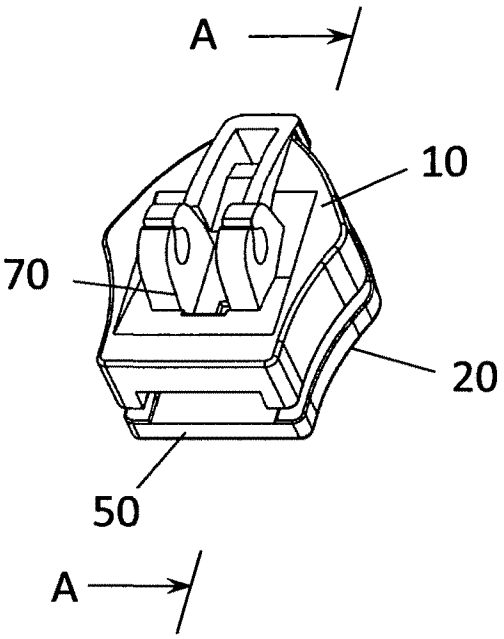
FIG. 1 is a perspective view of a zip slider body according to an embodiment of the present invention.

Referring now to FIGS. 1 to 5 a zip slider has a body comprising upper and lower interconnected elements 10, 20 which cooperate to form a pair of front channels 30, 40. Forward motion of the slider causes zip teeth (not shown) to pass into the front channels 30, 40 and through a single, central, rear channel 50 resulting in interdigitation of the zip teeth and thus fastening of the zip. Backwards motion reverses the process, causing extradigitation. and thus unfastening.

The slider body may be moved by means of a pull tab, 60, which is pivotally mounted on the upper element by means of the journaling of a cross shaft 62 at the base of the tab 60 within two bushes 70 integrated in the upper surface of the upper element 10 of the body.

Figure 7:
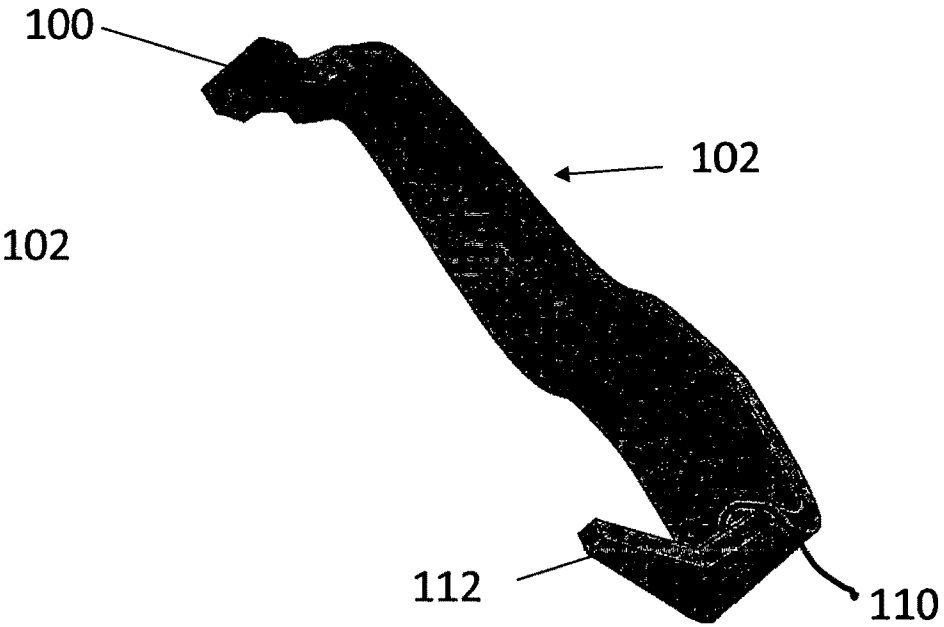
FIGS. 6 and 7 are perspective views of a leaf spring providing locking prong and cam follower surface.
Figure 6:
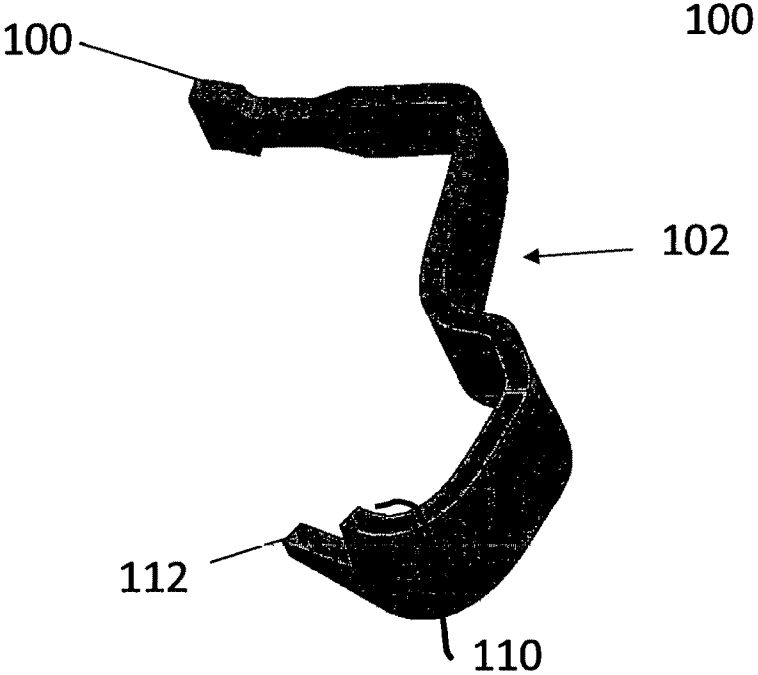
Figure 9:
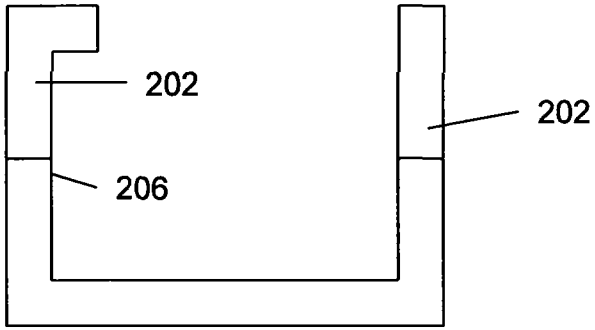
FIG. 9 is a plan view of the spring of FIG. 8.
Figure 8:
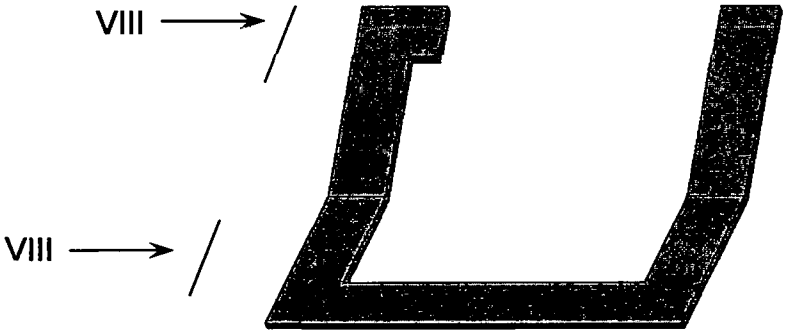
FIG. 8 is a perspective view of the counter bias spring.
Figure 10:
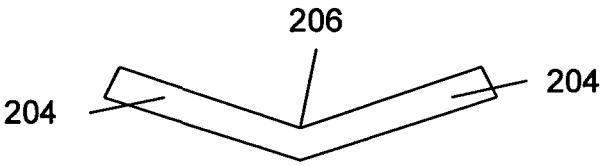
FIG. 10 is a side view of the spring of FIGS. 8 and 9.

Referring particularly now to FIGS. 6 and 7, the slider comprises a spring-loaded locking prong 100, which is located at one end of a formed, elongate leaf spring 102. The other end of the leaf spring comprises a follower surface 110, here provided by the internal surface of the end of the leaf spring 102 formed in the shape of a hook 112. When assembled, the hook 112 extends around the cross shaft 62, so that retention of the pull tab by location of the cross shaft 62 in the bushes 70 also then serves, by means of the hook being caught around the cross shaft 62, to retain the leaf spring 102 against the slider body in a position such that the locking prong 100 projects into the central channel via an aperture 12 in the upper element 10 of the body. Further, the most distal part 114 of the hook which is trapped under the cross shaft 62 then provides a fulcrum about which the locking prong 100 may pivot when the hook is opened out. Opening of the hook 112 and consequent pivoting of the locking prong about the fulcrum point will now be described.

The cross shaft 62 of the pull tab 60 supports a cam 64. The cam 64 and follower surface 110 provided by the inner surface of the hook 112 are both configured such that, when pull tab 60 is in the resting position illustrated in FIG. 3, i.e. where the nib 66 of the tab 60 lies flat and rear-facing against the upper element 10 of the body, the configuration of the hook 112 causes the follower surface 110 to apply a force to the cam 64. That force which urges the nib of the pull tab 60 against the upper element 10 and thus provides a resting bias which retains the pull tab 60 in the closed position. Further, in this position, the closing action of the hook 112 causes the locking prong 100 to project to its furthest possible extent into the central channel 40 where, in use, it will engage the interdigitated zip teeth with the result that, as a consequence of that engagement, the slider is locked against any motion relative to the zip teeth. When a user wishes to move the slider relative to the zip teeth, the user will grip the nib 66 and pivot the pull tab 60 into an upright position. When the pull tab 60 is in this position, the cam 64 acts on the follower surface 110 to push the hook 112 open a little. The consequence is then upward pivoting of the locking prong 100 which causes it to disengage from the knitted zip teeth, unlocking the slider from the zip and thereby permitting relative motion of the slider body and zip teeth.

Usually, when the pull tab 60 lies in the resting position, the locking prong 100 will project into the central channel and bear against the interdigitated zip teeth at a point in a ridge or valley created by the small space between two adjacent teeth. Occasionally, however, the locking prong may bear on top of a single zip tooth. When this happens, the prong does not project as far into the central channel 40 with the consequence that the hook 112 is stretched open a little (by comparison to the position when prong 110 is fully projected). This, in turn, prevents the follower surface 110 from applying as large a force to the cam 64, resulting in a reduction in the resting bias retaining the pull tab 60 in the resting position with the nib 66 flat adjacent the upper body 10. The pull tab may, consequently, then vibrate or wobble.

To ameliorate this outcome, a damping bias acts to urge the pull tab nib 66 away from the upper surface of the upper element 10 over a relatively small range of motion, thereby to stabilise the position of the pull tab, and most particularly to do so when the tab 60 is in the resting position and the locking prong bears against the top of a single zip tooth (so the resting bias is reduced). Equally, the small range of motion over which the damping bias acts ensures that the resting bias applied by cam 64 and follower surface 110 remains sufficient to retain the pull tab 60 in its resting position and yet, without the ability for it to vibrate or wobble.

Figure 4:
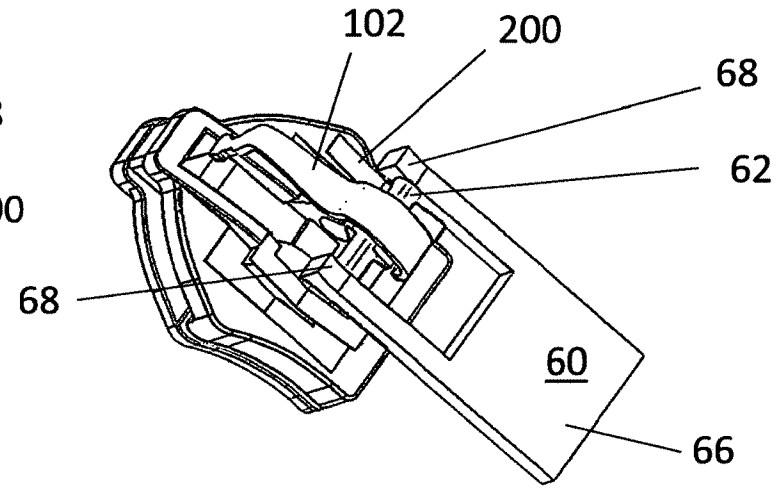
FIGS. 4 to 5 are perspective views of an assembled zip slider according to an embodiment of the present invention.
Figure 3:
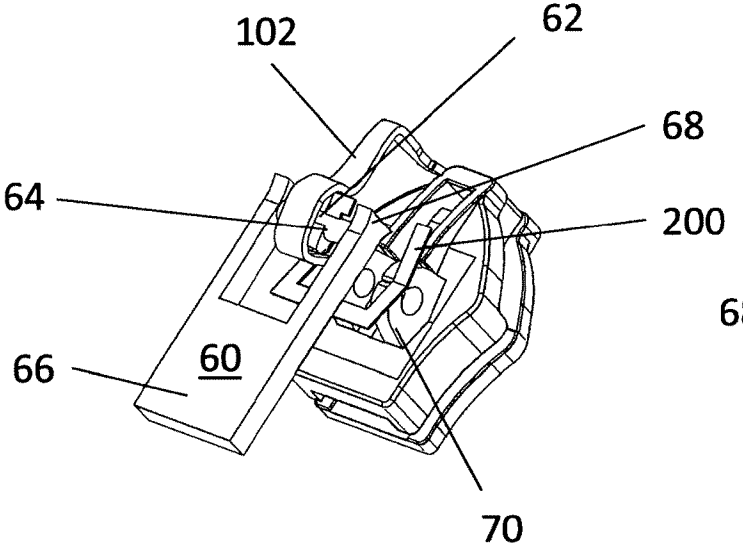
FIG. 3 is a perspective view of a zip slider with a pull tab in a resting position.
Figure 5:
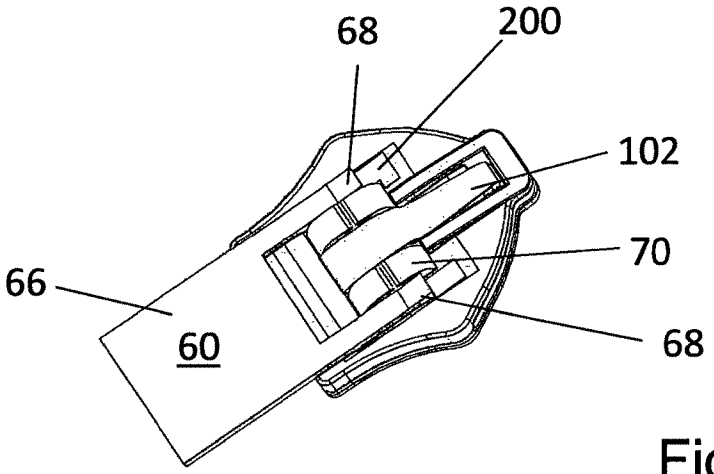

Referring now to FIGS. 7 to 10, in conjunction with, principally, FIGS. 2 to 4, in the present embodiment the damping bias is provided by a spring which, in the present embodiment, is a leaf spring 200. The leaf spring 200 has, when viewed in elevation, a U shape, which defines to U limbs 202 that extend around the bushes 70; and, in side view, a V shape which defines V limbs. The spring 200 sits in a corresponding V shaped recess 72 in the upper surface of the upper element 10 and is retained in position in this recess by means the action of a pair of feet 68 on the pull tab 60 which project beyond the cross shaft 62, in a direction distal to the nib 66. The configuration of the feet 68 is flared at their ends. Viewed in side view, when the pull tab 60 is in the closed position, the feet 68 of the pull tab 60 bear against one of the V limbs 204 and the body of the pull tab 60 bears against the other V limb 204 to retain the spring 200 on the slider body. When in the upright, open position, the edges of the flared feet 68 of the pull tab 62 bear against two points close to and substantially equidistant from the apex 206 of the V limbs 204 and, once again, act to retain the spring 200 on the slider body.

Further, when the pull tab 60 is in the closed position, one of the V limbs 204 bears against the body of the pull tab 60 with a first damping force, to prevent it from contacting the slider body. The feet 68 of the pull tab 60, however, also bear against the other V limb 204 with a second damping force and this, to some degree counteracts the rotational force (first damping force) applied on the nib 66 which acts to move it from the resting position. This configuration of the first and second damping forces therefore provides a damping bias which, over a small range of motion, opposes the resting bias. When the pull tab is stationary in the resting position, the damping bias and resting bias are in equilibrium. The damping bias does not, therefore, prevent the pull tab 60 from adopting the resting position. Rather, in the present embodiment, it serves firstly to alter the resting position so that the nib 66 is held a little out of contact with the upper body 10, and secondly, when in the resting position, damps vibration of the pull tab 60 and thereby prevents the nib 66 from travelling so far that it contacts the slider body in the resting position; the result being that the slider then has a robust, vibration and wobble free location for the pull tab 60 in the resting position regardless of whether the locking prong bears against the knitted zip teeth at a location between two teeth or on top of a single tooth.

The invention claimed is:

1. A zip slider comprising a body movable along opposing pairs of zip teeth to cause inter and extradigitation of the zip teeth;

a pull tab pivotally mounted to the body and having a resting position in which it lies against the body and a pulling position in which it is pivoted from the resting position;

a resting bias acting upon the pull tab, and through a first range of pivoting motion of the pull tab, the resting bias acting to urge the pull tab into the resting position, the resting bias comprising a cam upon the pull tab and a biasing spring retained to the body, the biasing spring comprising a follower surface which bears against the cam, wherein the pull tab includes a shaft journalled for rotation relative to the body, thereby to provide pivotal mounting of the pull tab relative to the body and a nib distal to the shaft by which the pull tab can be gripped, and wherein the cam is located on the shaft;

a locking prong engaged with interdigitated teeth to prevent relative motion of the slider and teeth when the pull tab is in the resting position, and disengaged to permit the relative motion when in the pulling position; and a damping bias comprising a damping spring acting to urge the pull tab relative to the body when in the resting position, wherein the damping spring acts between the body and the nib of the pull tab, thereby to urge the nib away from the body.

2. A zip slider according to claim 1 wherein the biasing spring has a locking prong and the cam and biasing spring are configured such that:

a). the action of the cam on the follower surface biases the pull tab into the resting position;

b). when the pull tab is in the resting position, the locking prong bears against the interdigitated teeth;

c) when the pull tab is in the pulling position, the action of the cam on the follower surface raises the locking prong above the teeth.

3. A zip slider according to claim 2 wherein, when the pull tab is in the resting position, the damping bias applies a resilient force to the pull tab against the action of the resting bias.

4. A zip slider according to claim 1 wherein the damping spring acts to apply a first damping force causing the nib to pivot away from the resting position.

5. A zip slider according to claim 4 wherein the pull tab further comprises a foot extending from the tab in the region of the shaft and distally from the nib and the damping spring additionally acts to apply a second damping force between the body and the foot to oppose pivoting of the nib away from the resting position.

6. A zip slider according to claim 5 wherein the damping bias is provided by the first and second damping forces.

7. A zip slider according to claim 6 wherein when the pull tab is stationary in the resting position, the damping bias and resting bias are in equilibrium.

* * * * *